US007616914B2

(12) United States Patent
Otani

(10) Patent No.: US 7,616,914 B2
(45) Date of Patent: Nov. 10, 2009

(54) COLOR IMAGE FORMING APPARATUS

(75) Inventor: Junichi Otani, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 257 days.

(21) Appl. No.: 11/839,371

(22) Filed: Aug. 15, 2007

(65) Prior Publication Data

US 2008/0069607 A1 Mar. 20, 2008

(30) Foreign Application Priority Data

Sep. 20, 2006 (JP) ..... 2006-254088

(51) Int. Cl.
*G03G 15/16* (2006.01)
*G03G 15/01* (2006.01)

(52) U.S. Cl. ..... 399/101; 399/302

(58) Field of Classification Search ..... 399/101, 399/300–303

See application file for complete search history.

(56) References Cited

U.S. PATENT DOCUMENTS 6,445,900 B2 * 9/2002 Fukao et al. ..... 399/302
6,934,497 B2 * 8/2005 Hagiwara et al. ..... 399/299

FOREIGN PATENT DOCUMENTS

JP 2001-318507 11/2001

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

There is described a color image forming apparatus, which makes it possible to prevent the intermediate transfer belt from slacking. The apparatus includes a plurality of image bearing members; an intermediate transfer belt onto which a full color toner image is formed; a driving roller to drive the intermediate transfer belt; a transfer unit to transfer the full color toner image onto a sheet; a cleaning unit to remove residual toner remaining on the intermediate transfer belt; a first tension applying unit, located upstream from the transfer unit in a circulating direction of the intermediate transfer belt, to apply a first tension onto the intermediate transfer belt; and a second tension applying unit, located downstream from the cleaning unit in the circulating direction of the intermediate transfer belt, to apply a second tension onto the intermediate transfer belt.

6 Claims, 6 Drawing Sheets

COLOR IMAGE FORMING APPARATUS

This application is based on Japanese Patent Application NO. 2006-254088 filed on Sep. 20, 2006 with Japan Patent Office, the entire content of which is hereby incorporated by reference.

BACKGROUND OF THE INVENTION

The present invention relates to a color image forming apparatus provided with a plurality of image bearing members and an intermediate transfer belt.

In recent years, image forming apparatuses employing an electro-photographic method, such as a copier, a printer, a facsimile, etc., have been widely introduced in various office environments. Specifically, a lot of color image forming apparatuses capable of outputting a color image onto a sheet have been widely introduced in the market.

Various kinds of configurations have been employed in such the color image forming apparatuses as mentioned in the above. Recently, among other things, a tandem-type color image forming apparatus, in which unicolor toner images are respectively formed on a plurality of photoreceptor drums (image bearing members) and superimposed with each other on the intermediate transfer belt so as to form a color image on it, has been emerged in the market. According to the tandem-type color image forming apparatus, it is possible to achieve both the high image quality and the high productivity in the production of color image products.

In this connection, the intermediate transfer belt, employed in the tandem-type color image forming apparatus, is threaded on a plurality of supporting rollers so as to make it circulatable along the photoreceptor drums. However, since various constituents, such as the plurality of photoreceptor drums, a transfer roller, etc., contact the intermediate transfer belt, sometimes, a part of the intermediate transfer belt slacks under influence of the load incurred onto the intermediate transfer belt during its circulating action. Once the intermediate transfer belt slacks, fluctuations of the circulating velocity of the intermediate transfer belt would occur and result in a transferring deficiency, etc. This would cause a problem of the reproduced image quality.

Conventionally, to cope with the abovementioned problem, various techniques for preventing the intermediate transfer belt from slacking have been proposed so far.

For instance, Patent Document 1 (Tokkai 2001-318507, Japanese Non-Examined Patent Publication) sets forth a technology, which makes it possible to install the tension rollers for giving a tension to the intermediate transfer belt into the inside space surrounded by the inner circumferential surface of the intermediate transfer belt. According to the above technology, it becomes possible not only to alleviate the slack to be generated on the intermediate transfer belt, but also to conduct the image forming operation well.

However, considerations in the technology set forth in Patent Document 1 are not sufficient as a countermeasure for preventing the intermediate transfer belt from slacking, with respect to a color image forming apparatus in which a driving roller for circulating the intermediate transfer belt, a transfer roller for transferring a color toner image formed on the intermediate transfer belt onto a sheet, etc. are separately driven by the separate motors. Referring to FIG. 5 through FIG. 7, the abovementioned point will be detailed in the following.

FIG. 5 shows a brief configuration of a conventional color image forming apparatus.

A conventional color image forming apparatus 1000 is so constituted that unicolor toner images are respectively formed on a plurality of photoreceptor drums 1100, 1101, 1102, 1103, and successively, superimposed with each other onto an intermediate transfer belt 1200 so as to form a full color toner image on it, and then, the full color toner image residing on the intermediate transfer belt 1200 is transferred onto a sheet by a transfer roller 1400.

A driving roller 1300 drives the intermediate transfer belt 1200 to circulate it in a direction indicated by an arrow X shown in FIG. 5 while supporting the intermediate transfer belt 1200. The transfer roller 1400 serves as a roller for transferring the full color toner image formed on the intermediate transfer belt 1200 onto the sheet. A cleaning brush 1500 rotates in a predetermined direction, so as to remove residual toner remaining on the intermediate transfer belt 1200.

The driving roller 1300 is rotated by a driving force transmitted from a driving motor 1301, the transfer roller 1400 is rotated by a driving force transmitted from a driving motor 1401 and the cleaning brush 1500 is rotated by a driving force transmitted from a driving motor 1501. In other words, the driving roller 1300, the transfer roller 1400 and the cleaning brush 1500 are driven by the separate motors, respectively.

FIG. 6 shows an enlarged view of a configuration in the periphery of the transfer roller 1400.

As mentioned in the above, the driving roller 1300 and the transfer roller 1400 are rotated by the driving forces transmitted from the separate driving motors 1301, 1401, respectively. Further, the driving roller 1300 rotates in a direction indicated by an arrow X1 shown in FIG. 6, while the transfer roller 1400 rotates in a direction indicated by an arrow X2 shown in FIG. 6. During the time when the transfer roller 1400 contacts the intermediate transfer belt 1200, since the intermediate transfer belt 1200 is pulled in its circulating direction by the driving force generated by the transfer roller 1400, no slack is generated on the intermediate transfer belt 1200. However, the friction force generated between the transfer roller 1400 and the intermediate transfer belt 1200 is liable to fluctuate under the influences of the image forming conditions, such as a density of an image to be transferred, environmental conditions, presence or absence of a sheet at a transfer nip portion, etc. Sometimes, this would cause the slack on a portion $\alpha$ of the intermediate transfer belt 1200 shown in FIG. 6.

FIG. 7 shows an enlarged view of a configuration in the periphery of the cleaning brush 1500.

The cleaning brush 1500 rotates in a direction indicated by an arrow X3 shown in FIG. 7. Although the cleaning brush 1500 removes the residual toner remaining on the intermediate transfer belt 1200, the friction force generated between the cleaning brush 1500 and the intermediate transfer belt 1200 is liable to fluctuate depending on an amount of residual toner remaining on the intermediate transfer belt 1200. Accordingly, sometimes, this would cause the slacks on portions $\beta$1, $\beta$2 of the intermediate transfer belt 1200 shown in FIG. 7, under the influence of the driving force for the cleaning brush 1500.

SUMMARY OF THE INVENTION

Accordingly, to overcome the abovementioned drawbacks in conventional color image forming apparatus, at least one of objects of the present invention can be attained by the color image forming apparatuses described as follows.

(1) According to a color image forming apparatus reflecting an aspect of the present invention, the color image forming apparatus comprises: a plurality of image bearing members; an intermediate transfer belt onto which unicolor toner images, respectively formed on the plurality of image bearing members, are sequentially transferred so as to form a full color toner image on the intermediate transfer belt; a driving roller to drive the intermediate transfer belt; a driving motor to generate a first driving force to be applied to the driving roller; a transfer unit to transfer the full color toner image formed on the intermediate transfer belt onto a sheet; a transfer motor, disposed separately from the driving motor, to generate a second driving force to be applied to the transfer unit; a cleaning unit to remove residual toner remaining on the intermediate transfer belt; a cleaning motor, disposed separately from the driving motor, to generate a third driving force to be applied to the cleaning unit; a first tension applying unit, located upstream from the transfer unit in a circulating direction of the intermediate transfer belt, to apply a first tension onto the intermediate transfer belt; and a second tension applying unit, located downstream from the cleaning unit in the circulating direction of the intermediate transfer belt, to apply a second tension onto the intermediate transfer belt.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
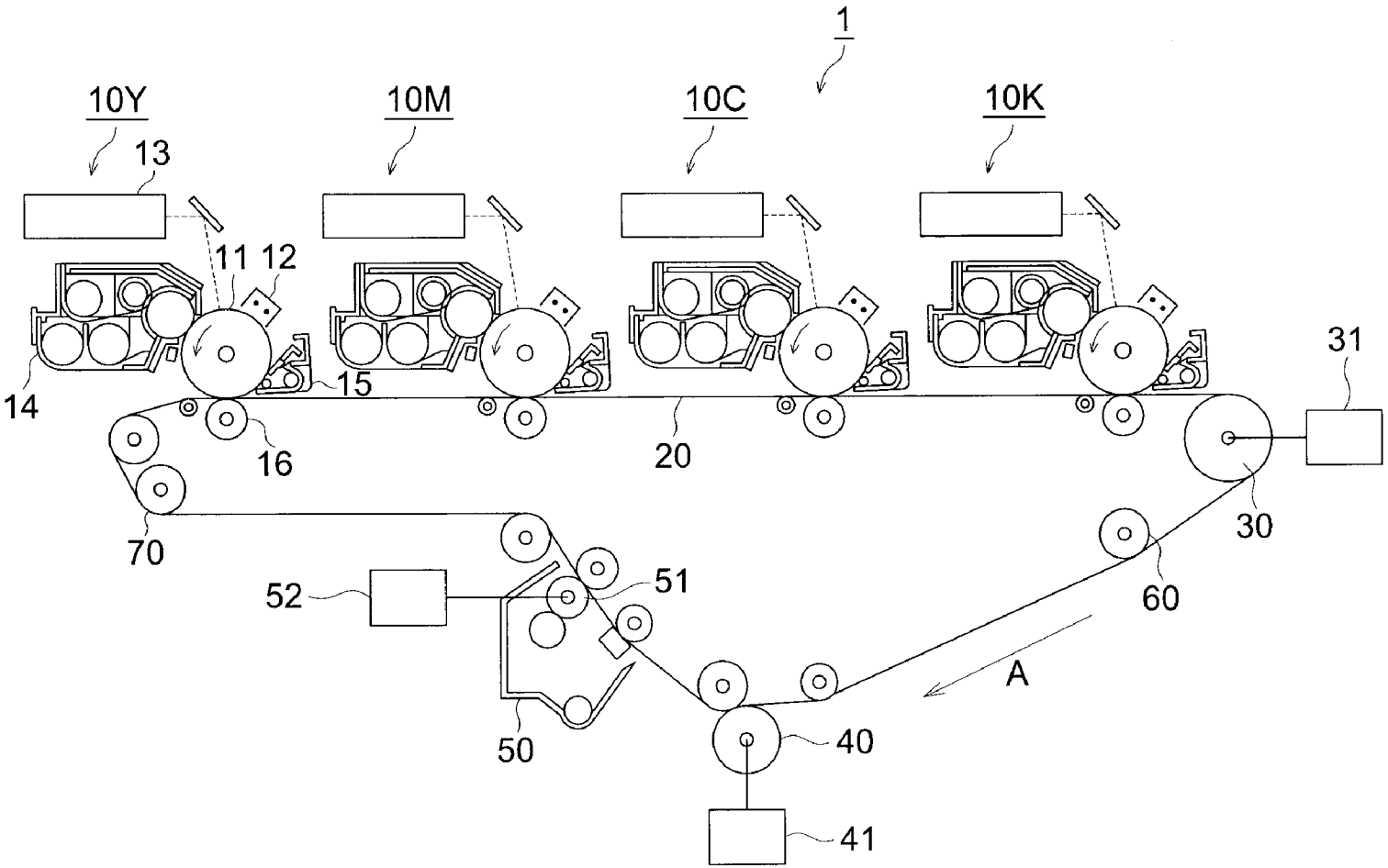
FIG. 1 shows a brief configuration of a color image forming apparatus embodied in the present invention.

FIG. 1 shows a brief configuration of a color image forming apparatus 1 embodied in the present invention.

The color image forming apparatus 1 is a tandem-type color image forming apparatus provided with an intermediate transfer belt 20.

Four sets of image forming sections 10Y, 10M, 10C, 10K for forming unicolor toner images of colors Y (Yellow), M (Magenta), C (Cyan) and K (Black) are disposed on an upper side of the intermediate transfer belt 20. The image forming sections 10Y, 10M, 10C, 10K are aligned in a line in this sequence from left to right and have the same configuration. Referring to the image forming section 10Y as an example, its configuration will be detailed in the following. The image forming section 10Y is constituted by a photoreceptor drum 11, serving as a image bearing member, a scorotron charger 12, an exposing unit 13, a developing unit 14 and a cleaning unit 15.

The intermediate transfer belt 20 is shaped in an endless belt and has a predetermined volume resistivity. A primary transfer electrode 16 is disposed at a position opposing to the photoreceptor drum 11 while putting the intermediate transfer belt 20 between them.

Next, a color image forming method for forming a color image will be detailed in the following.

The photoreceptor drum 11 is driven to rotate by a main motor (not shown in the drawings) and is charged at a negative voltage (for instance, −800 volts) by the discharging action of the scorotron charger 12. Successively, the exposing unit 13 performs the optical image writing action corresponding to the image data, so as to form an electrostatic latent image on the circumferential surface of the photoreceptor drum 11. When the electrostatic latent image formed by the exposing unit 13 passes through the developing unit 14, toner charged at a negative polarity in the developing unit 14 are attracted and adhered to portions of the electrostatic latent image so as to form a toner image on the circumferential surface of the photoreceptor drum 11. Successively, the formed toner image is transferred onto the intermediate transfer belt 20, which press-contacts the photoreceptor drum 11. Then, the residual toner remaining on the photoreceptor drum 11 is cleaned by the cleaning unit 15. Since the unicolor toner images respectively formed on the image forming sections 10Y, 10M, 10C, 10K are sequentially transferred onto the intermediate transfer belt 20 in such a manner that the unicolor toner images are superimposed with each other, a full color toner image is formed on the intermediate transfer belt 20. On the other hand, a sheet, onto which the full color toner image is to be formed, is conveyed into a transfer nip portion by the intermediate transfer belt 20 and a transfer roller 40 serving as a transferring section, while the transfer roller 40 press-pushes the sheet onto the intermediate transfer belt 20 so as to tightly clip it between them. By applying a bias voltage having a polarity opposite to that of the toner (for instance, +500 volts) onto the transfer roller 40, the full color toner image residing on the intermediate transfer belt 20 is transferred onto the sheet. The sheet having the transferred toner image is further conveyed into a fixing unit (not shown in the drawings). Successively, the residual toner remaining on the intermediate transfer belt 20 are removed by a belt cleaning unit 50 serving as a cleaning section.

A driving roller 30 drives the intermediate transfer belt 20 to rotate in a direction indicated by an arrow A shown in FIG. 1, while supporting the intermediate transfer belt 20. The driving roller 30 is rotated by a driving force generated by a driving motor 31.

The transfer roller 40 is rotated by a driving force generated by a transfer motor 41 disposed separately from the driving motor 31, while a cleaning brush 51 included in the belt cleaning unit 50 is rotated by a driving force generated by a cleaning motor 52 disposed separately from the driving motor 31. In this connection, it is also applicable that, considering the installation space and cost, the same motor is employed as both the transfer motor 41 and the cleaning motor 52.

A tension roller 60 and a tension roller 70, both detailed later, apply tensions to the intermediate transfer belt 20.

Figure 2:
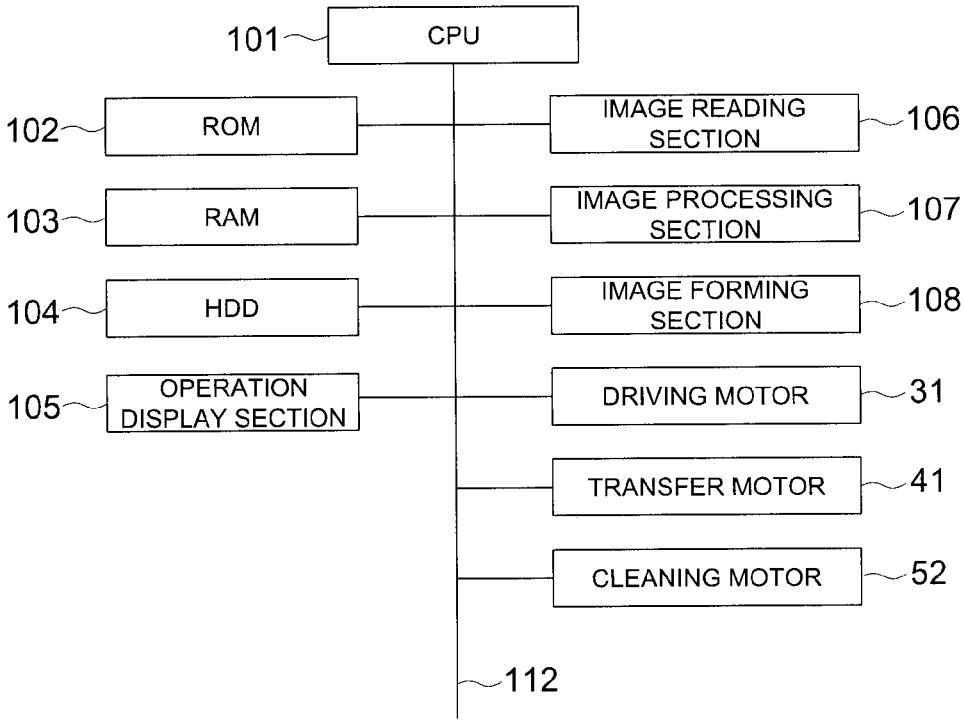
FIG. 2 shows a block diagram of a control system of a color image forming apparatus embodied in the present invention.

FIG. 2 shows a block diagram of a control system of the color image forming apparatus 1, indicating a typical configuration of such the control system.

A CPU (Central Processing Unit) 101 is coupled to a ROM (Read Only Memory) 102, a RAM (Random Access Memory) 103, etc., through a system bus 112, so as to control overall operations of the color image forming apparatus 1. The CPU 101 reads out various kinds of control programs stored in the ROM 102 and develops the control programs into the RAM 103 to control operations of each of the sections. Further, the CPU 101 executes the control programs developed into the RAM 103 in order to implements various kinds of processing, and stores the processing results into the RAM 103, while displaying them on an operation display section 105. Further, the CPU 101 stores the processing results stored into the RAM 103 into a predetermined storage.

The ROM 102 includes a magnetic storage medium, an optical storage medium and/or a semiconductor memory so as to store various kinds of program, data, etc. in advance.

A working area, in which various kinds of data, etc. generated or processed by the various kinds of programs executed by the CPU 101 are temporarily stored, is created in the RAM 103.

An HDD (Hard Disc Drive) 104 has a function for storing image data acquired by reading an original document image through an image reading section 106, outputted image data, etc. The HDD 104 is constituted by a plurality of metallic discs on each of which a magnetic material is coated or vapor-deposited and which overlap with each other at constant intervals. In the HDD 104, read/write operations are achieved by making magnetic heads approach the surfaces of the metallic discs, being rotated at high velocity by a disc driving motor.

The operation display section 105 makes it possible to input various kinds of settings. For instance, a touch panel is employed in the operation display section 105, so that the user can establish conditions for the color printing or the monochromatic printing by inputting instructions through the touch panel of the operation display section 105. Further, at the same time, various kinds of information, such as setting information of the network, etc., are displayed on the operation display section 105.

The image reading section 106 optically reads the original document image so as to convert it to electric signals. When reading a color document image, the image reading section 106 generates image data having RGB 10-bit luminance information for every pixel.

An image processing section 107 applies image processing to the image data generated by the image reading section 106 and/or the image data transmitted from a personal computer coupled to the color image forming apparatus 1. When the color printing operation is implemented in the color image forming apparatus 1, R (Red), G (Green) and B (Blue) image data, generated by the image reading section 106, etc., are inputted into a color conversion LUT (Look Up Table), so as to convert the R, G and B image data to Y (Yellow), M (Magenta), C (Cyan) and Bk (Black) image data. Successively, various kinds of image processing, such as a correction of gradation reproducing characteristic, a screen processing of halftone dots referring to a gradation correcting LUT, an edge processing for enhancing narrow lines, etc., are applied to the Y (Yellow), M (Magenta), C (Cyan) and Bk (Black) image data converted in the above.

An image forming section 108 receives the Y (Yellow), M (Magenta), C (Cyan) and Bk (Black) image data processed by the image processing section 107, so as to form a reproduced image on the sheet.

The CPU 101 controls operations of the driving motor 31 for driving the driving roller 30, the transfer motor 41 for driving the transfer roller 40 and the cleaning motor 52 for driving the cleaning brush 51.

Incidentally, when a slack is generated on the intermediate transfer belt 20, there would occur a problem of the image quality, such as the transferring deficiency caused by the variation of the rotating velocity of the intermediate transfer belt 20. Therefore, it is necessary to prevent the intermediate transfer belt 20 from slacking.

Initially, the method for preventing the intermediate transfer belt 20 from generating the slack due to the transfer roller 40 will be detailed in the following.

Figure 3:
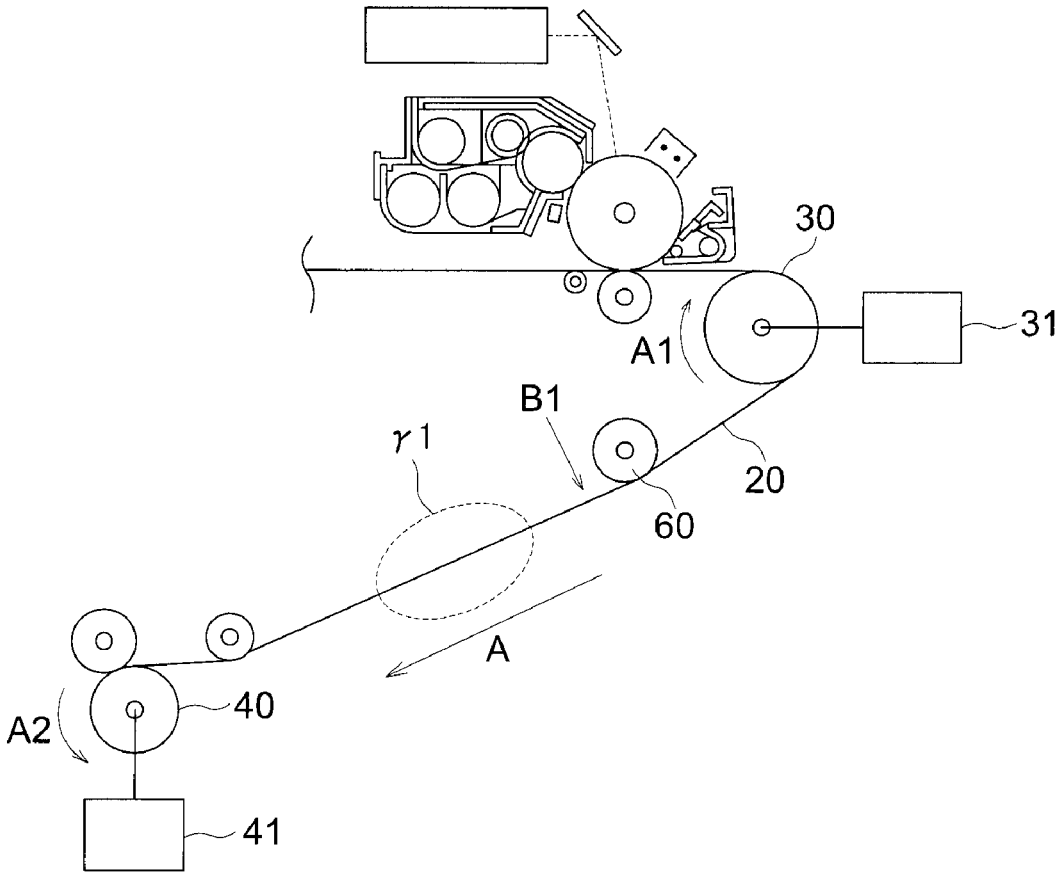
FIG. 3 shows an enlarged view of a configuration in the periphery of a transfer roller.

FIG. 3 shows an enlarged view of the configuration in the periphery of the transfer roller 40.

Compared to the transferring operation employing the corona discharging action, the transferring operation conducted by the transfer roller 40 has such advantageous features that a little amount of ozone is generated and no transfer unevenness, caused by the contamination of the discharging wire, etc., emerges on the reproduced image. The transfer roller 40 is constituted by an axial body (core metal) made of, for instance, a stainless steel bar, and a roller section, which is made of a resin material, such as a foamed silicon resin, an expanded polyurethane resin or an EMPD resin, and formed on a circumferential surface of the axial body.

The driving roller 30 for driving the intermediate transfer belt 20 is rotated in a direction indicated by an arrow A1 shown in FIG. 3 by the driving force transmitted from the driving motor 31. On the other hand, the transfer roller 40 is rotated in a direction indicated by an arrow A2 shown in FIG. 3 by the driving force transmitted from the transfer motor 41 disposed separately from the driving motor 31 to improve the transferability of the transfer roller 40.

During the time when the transfer roller 40 contacts the intermediate transfer belt 20, since the intermediate transfer belt 20 is pulled in its circulating direction by the driving force generated by the transfer roller 40, no slack is generated on the intermediate transfer belt 20. However, the friction force generated between the transfer roller 40 and the intermediate transfer belt 20 is liable to fluctuate under the influences of the image forming conditions, such as density of an image to be transferred, environmental conditions, presence or absence of the sheet at the transfer nip portion, etc. Sometimes, this would cause the slack on a portion γ1 of the intermediate transfer belt 20 shown in FIG. 3.

Accordingly, to alleviate the abovementioned slack, the tension roller 60, serving as an upstream tension adding member, is disposed at a position upstream from the transfer roller 40 in respect to the circulating direction of the intermediate transfer belt 20. The tension roller 60 applies a tension in a direction indicated by an arrow B1 shown in FIG. 3 to the intermediate transfer belt 20. For instance, a mechanical structure for pushing both ends of an axis of the tension roller 60 in the direction indicated by the arrow B1 by urging springs could be applicable for this purpose. Further, another mechanical structure for urging the both ends of the axis of the tension roller 60 by a cam would be also applicable for this purpose.

As mentioned in the above, by disposing the tension roller 60 at the position upstream from the transfer roller 40 in respect to the circulating direction of the intermediate transfer belt 20 so as to apply the tension onto the intermediate transfer belt 20, the tension roller 60 can absorb the slack of the intermediate transfer belt 20, even if the friction force between the transfer roller 40 and the intermediate transfer belt 20 fluctuates. As a result, no slack is generated on the intermediate transfer belt 20 and it becomes possible to stabilize the image quality of the reproduced image formed on the sheet.

Next, the method for preventing the intermediate transfer belt 20 from generating the slack due to the cleaning brush 51 will be detailed in the following.

Figure 4:
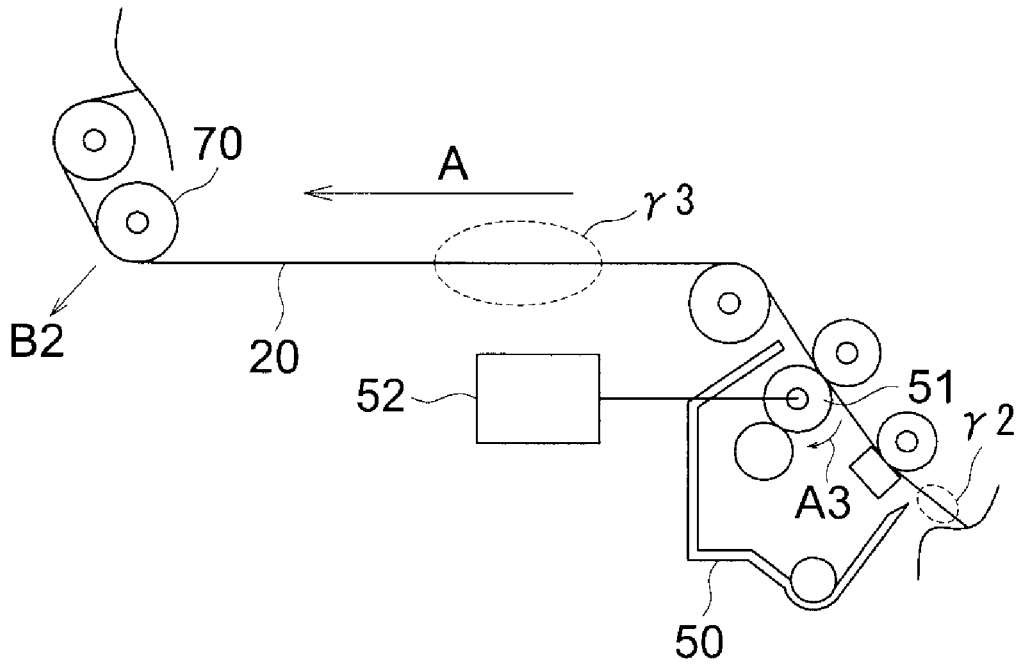
FIG. 4 shows an enlarged view of a configuration in the periphery of a cleaning brush.
Figure 5:
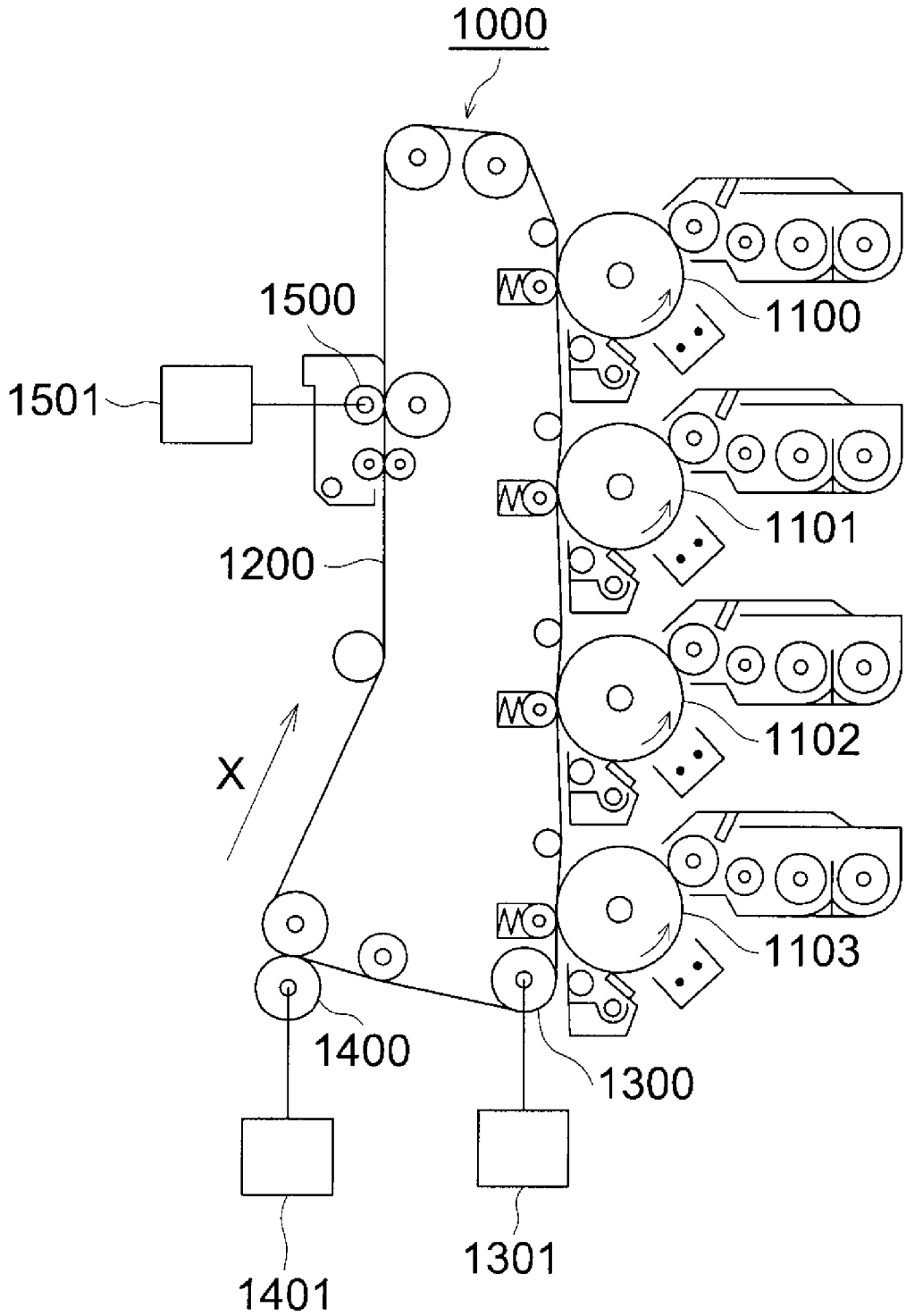
FIG. 5 shows a brief configuration of a conventional color image forming apparatus.
Figure 6:
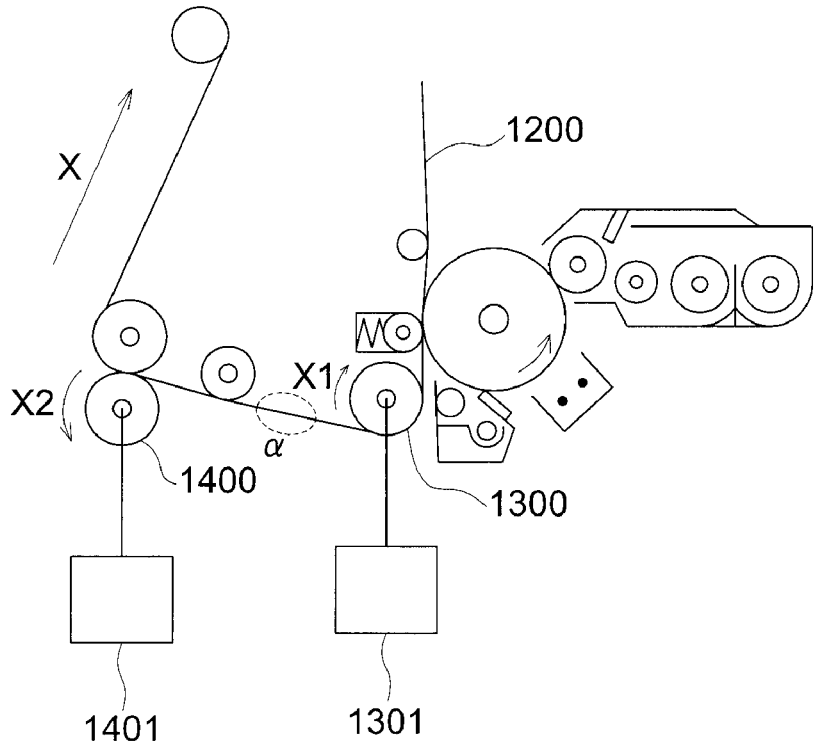
FIG. 6 shows an enlarged view of a configuration in the periphery of a transfer roller employed in a conventional color image forming apparatus.
Figure 7:
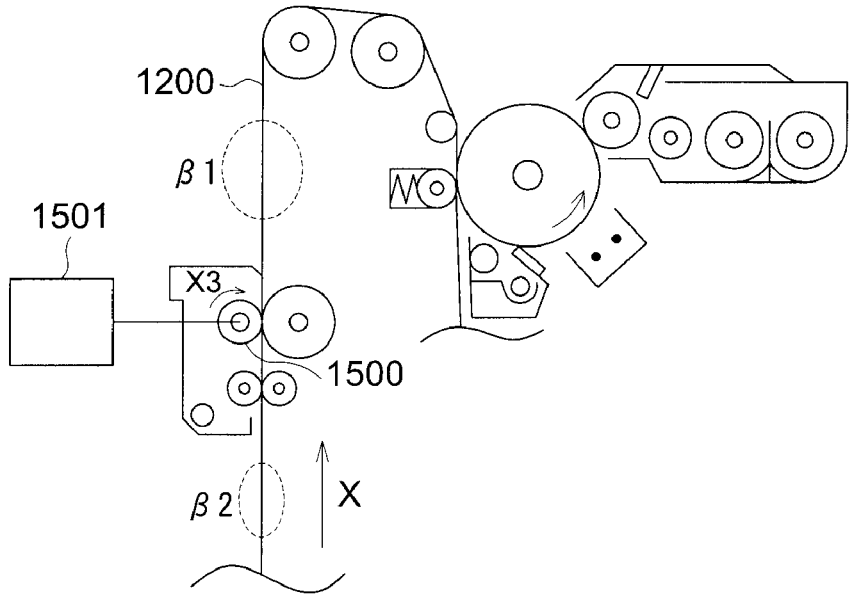
FIG. 7 shows an enlarged view of a configuration in the periphery of a cleaning brush employed in a conventional color image forming apparatus.

FIG. 4 shows an enlarged view of the configuration in the periphery of the cleaning brush 51.

The cleaning brush 51 is disposed in the belt cleaning unit 50 so that the residual toner attached onto the intermediate transfer belt 20 are removed by rotating the cleaning brush 51. For instance, the cleaning brush 51 is formed by filling brush fibers onto a circumferential surface of a rolled core material.

The cleaning brush 51 is rotated in a direction indicated by an arrow A3 shown in FIG. 4 by the driving force transmitted from the cleaning motor 52 disposed separately from the driving motor 31 to improve the cleanability of the cleaning brush 51. Although the cleaning brush 51 removes the residual toner remaining on the intermediate transfer belt 20, the friction force generated between the cleaning brush 51 and the intermediate transfer belt 20 is liable to fluctuate depending on an amount of the residual toner remaining on the intermediate transfer belt 20. This would cause the slacks on portions γ2 and γ3 of the intermediate transfer belt 20 shown in FIG. 4, under the influence of the driving force of the cleaning brush 51.

Accordingly, to alleviate the abovementioned slacks, the tension roller 70, serving as a downstream tension adding member, is disposed at a position downstream from the cleaning brush 51 in respect to the circulating direction of the intermediate transfer belt 20. The tension roller 70 applies a tension in a direction indicated by an arrow B2 shown in FIG. 4 to the intermediate transfer belt 20. A mechanical structure being same as that of the tension roller 60 could be considered. For instance, a mechanical structure for pushing both ends of an axis of the tension roller 70 in the direction indicated by the arrow B2 by urging springs could be applicable for this purpose. Further, another mechanical structure for urging the both ends of the axis of the tension roller 70 by a cam would be also applicable for this purpose.

As mentioned in the above, by disposing the tension roller 70 at the position downstream from the cleaning brush 51 in respect to the circulating direction of the intermediate transfer belt 20 so as to apply the tension onto the intermediate transfer belt 20, the tension roller 60 can absorb the slacks of the intermediate transfer belt 20, even if the friction force between the cleaning brush 51 and the intermediate transfer belt 20 fluctuates. As a result, none of slacks are generated on the intermediate transfer belt 20 and it becomes possible to stabilize the image quality of the reproduced image formed on the sheet.

As detailed in the foregoing by referring to FIG. 3 and FIG. 4, by disposing the tension roller 60 at the position upstream from the transfer roller 40 and the tension roller 70 at the position downstream from the cleaning brush 51, it becomes possible even for the color image forming apparatus, in which the driving roller 30, the transfer roller 40, etc. are respectively driven by separate motors, to alleviate the slacks to be generated on the intermediate transfer belt 20, resulting in a stability of the reproduced image quality.

Referring to the drawings, the embodiment of the present invention has been detailed in the foregoing. However, the scope of the present invention is not limited to the embodiment aforementioned. Modifications and additions applied to the exemplified embodiment by a skilled person without departing from the spirit and scope of the invention shall be included in the scope of the present invention.

While the preferred embodiments of the present invention have been described using specific term, such description is for illustrative purpose only, and it is to be understood that changes and variations may be made without departing from the spirit and scope of the appended claims.

What is claimed is:

1. A color image forming apparatus, comprising:

a plurality of image bearing members;

an intermediate transfer belt onto which unicolor toner images, respectively formed on the plurality of image bearing members, are sequentially transferred so as to form a full color toner image on the intermediate transfer belt;

a driving roller to drive the intermediate transfer belt;

a driving motor to generate a first driving force to be applied to the driving roller;

a transfer unit to transfer the full color toner image formed on the intermediate transfer belt onto a sheet;

a transfer motor, disposed separately from the driving motor, to generate a second driving force to be applied to the transfer unit;

a cleaning unit to remove residual toner remaining on the intermediate transfer belt;

a cleaning motor, disposed separately from the driving motor, to generate a third driving force to be applied to the cleaning unit;

a first tension applying unit, located upstream from the transfer unit in a circulating direction of the intermediate transfer belt, to apply a first tension onto the intermediate transfer belt; and a second tension applying unit, located downstream from the cleaning unit in the circulating direction of the intermediate transfer belt, to apply a second tension onto the intermediate transfer belt.

2. The color image forming apparatus of claim 1, wherein the transfer unit includes a transfer roller, which pushes the sheet against the intermediate transfer belt with pressure, so as to transfer the full color toner image from the intermediate transfer belt to the sheet; and wherein the transfer roller is rotated by the second driving force, generated by the transfer motor.

3. The color image forming apparatus of claim 1, wherein the cleaning unit includes a cleaning brush, which brushes the intermediate transfer belt so as to remove the residual toner remaining on the intermediate transfer belt; and wherein the cleaning brush is rotated by the third driving force generated by the cleaning motor.

4. The color image forming apparatus of claim 1, wherein a single motor, serving as both the transfer motor and the cleaning motor, generates both the second driving force and the third driving force.

5. The color image forming apparatus of claim 1, wherein the first tension applying unit and the second tension applying unit are disposed in such a manner that the first tension applying unit and the second tension applying unit contact respective positions on an inner circumferential surface of the intermediate transfer belt.

6. The color image forming apparatus of claim 1, wherein the first tension applying unit includes a first tension roller, which contacts the intermediate transfer belt with the first tension so as to prevent the intermediate transfer belt from slacking, while the second tension applying unit includes a second tension roller, which contacts the intermediate transfer belt with the second tension so as to prevent the intermediate transfer belt from slacking.

* * * * *